US007066345B2

(12) United States Patent
Itokawa et al.

(10) Patent No.: US 7,066,345 B2
(45) Date of Patent: Jun. 27, 2006

(54) BOTTOM STRUCTURE OF BOTTLE-SHAPED CONTAINER MADE OF SYNTHETIC RESIN

(75) Inventors: Juichi Itokawa, Koto-Ku (JP); Yoshinori Matsuo, Koto-Ku (JP); Takao Iizuka, Koto-Ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 135 days.

(21) Appl. No.: 10/658,197

(22) Filed: Sep. 10, 2003

(65) Prior Publication Data

US 2004/0060896 A1 Apr. 1, 2004

(30) Foreign Application Priority Data

Sep. 30, 2002 (JP) ..... 2002-285442

(51) Int. Cl.
*B65D 1/02* (2006.01)
*B65D 1/42* (2006.01)

(52) U.S. Cl. ..... 215/375; 215/373; 220/606

(58) Field of Classification Search ..... 215/373, 215/375; 220/606, 608, 609
See application file for complete search history.

(56) References Cited

U.S. PATENT DOCUMENTS 3,403,804 A * 10/1968 Colombo ..... 215/45
4,054,219 A * 10/1977 Young et al. ..... 215/375
4,850,493 A * 7/1989 Howard, Jr. ..... 215/375
4,850,494 A * 7/1989 Howard, Jr. ..... 215/375
D308,630 S * 6/1990 Cochran et al. ..... D9/520
5,071,015 A * 12/1991 Kinslow ..... 215/375
5,222,615 A * 6/1993 Ota et al. ..... 215/375
5,927,499 A * 7/1999 Vesborg ..... 206/509
D412,849 S * 8/1999 Fuquen et al. ..... D9/542
5,988,417 A * 11/1999 Cheng et al. ..... 215/383
6,269,962 B1 * 8/2001 Anderson et al. ..... 215/398
6,277,321 B1 * 8/2001 Vailliencourt et al. ..... 264/529

FOREIGN PATENT DOCUMENTS

JP A 5-254532 10/1993
WO WO 95/25041 9/1995

* cited by examiner

*Primary Examiner*—Sue A. Weaver
(74) *Attorney, Agent, or Firm*—Oliff & Berridge, PLC

(57) ABSTRACT

A bottom structure of a biaxially-oriented blow-molded bottle-shaped container is made of a synthetic resin and includes a neck, a shoulder, a body and a bottom. The bottom has a connecting cylindrical wall, a tapered-cylindrical wall, a bottom wall and a grounding wall. A diameter of the tapered-cylindrical wall is decreased downwardly at a certain inclined angle. The bottom wall is domed to an inside of the container. The grounding wall is in a ring plate shape and arranged between a lower edge of the tapered-cylindrical wall and a lower edge of the bottom wall. Each of groove ribs is formed from an upper edge of the tapered-cylindrical wall through the grounding wall to the lower edge of the bottom wall. The groove ribs are arranged with isometric center angle, and extend radially.

2 Claims, 3 Drawing Sheets

BOTTOM STRUCTURE OF BOTTLE-SHAPED CONTAINER MADE OF SYNTHETIC RESIN

BACKGROUND OF THE INVENTION

The present invention relates to a bottom structure of a biaxially-oriented blow-molded bottle-shaped container made of a synthetic resin such as polyethylene terephthalate or the like, which bottom structure has high mechanical strength such as impact resistance and stably exerts good "seat" function.

In a general structure of a self-standable bottom of a biaxially-oriented blow-molded bottle-shaped container made of a synthetic resin, particularly polyethylene terephthalate, a bottom wall is constructed in a domed shape, wherein a lower edge of said bottom wall and a lower edge of a container body are connected with a ground wall of in convex state downwardly, and said ground wall functions as a leg, so that the bottle-shaped container is self-standable.

Since the above described bottle-shaped container is formed by biaxially-oriented blow-molding, an orientation magnification at the ground wall that functions as the leg for the bottom is large. Hence, there is a disadvantage that a thickness of the wall at the ground wall tends to be thin. In particular, in case of a large bottle-shaped container with a content of 2 liters or more, such thin wall at the ground wall may be cause insufficient mechanical strength and unsteady "seat" function of the bottle-shaped container.

Particularly, in recent time, due to strong requirement of minimization of resource consumption, the thickness of a bottle-shaped container of the above-described type tends to be thinner. Hence, there is a strong tendency such that the thickness at the ground wall tends to be further thin. Hence, the above-described disadvantage occurs remarkably and more easily.

In order to resolve the above-described disadvantage, JP-A-H09-510168 (derived from WO-A1-95-25041, particularly, claims, FIG. 2 and FIG. 4) discloses a bottle-shaped container comprising a neck designed so as to adapt to receive a cap, a substantially cylindrical side wall, and a bottom, wherein said bottom has a concaved or hollowed central portion and a convex circumferential surface wall, said convex circumferential surface wall includes radially-arranged grooves and connects to the concave central portion in the bottom via a substantially flat annular surface, and each of the radially-arranged grooves at a bottom thereof and the flat annual surface are substantially in contact and connected with each other.

Further, JP-A-H05-254532 discloses a bottle circumferentially formed with a plurality of bottom-reinforcing sections comprising concave and/or convex portions in a proximity of a lower end of a wall of a bottom.

In said JP-A-H09-510168, however, a thickness of the circumferential surface wall is thin, because the blow ratio of the circumferential wall that forms legs is high. Therefore, the grooves can reinforce the circumferential surface only near the grooves. Hence, there is a problem that a number of grooves are required to be provided, whereby a structure of the bottom becomes complex, and that differences in thicknesses between the groove portions and the circumferential surface wall portions occur consequentially, so that said differences cause the thickness of the circumferential surface further thin.

In said JP-A-H05-254532, since said bottom-reinforcing sections are provided in the circumferential wall portion (that is, a heel portion of the bottle, where the bottom is connected to the body), only the heel portion is reinforced in the bottom. A portion exerting grounding function is not reinforced at all. Hence, there is a problem in the past that stable "seat" function cannot be obtained by JP-A-H05-254532.

SUMMARY OF THE INVENTION

The present invention, therefore, is devised in order to resolve the above-described problems, and it is an object of the present invention to provide a bottom structure of a biaxially-oriented blow-molded bottle-shaped container made of a synthetic resin, said bottom structure has high mechanical strength, such as high impact resistance and shape retention performance and stably exerts good "seat" function, to thereby achieve production of the bottle-shaped container with larger size without difficulty.

In order to solve the above-described technical problem, the present invention provides a biaxially-oriented blow-molded bottle-shaped container made of a synthetic resin, comprises a neck, a shoulder, a body and a bottle section, wherein the bottom has a connecting cylindrical wall, a tapered-cylindrical wall, a bottom wall and a grounding wall, said connecting cylindrical wall connects to a lower end of the body, said tapered-cylindrical wall connects to a lower end of the connecting cylindrical wall, a diameter of said tapered-cylindrical wall is decreased downwardly at a certain inclined angle, said bottom wall is domed to an inside of the container, said grounding wall is formed in a ring plate shape, and is arranged between a lower edge of the tapered-cylindrical wall and a lower edge of the bottom wall, each of a plurality of groove ribs is formed from an upper edge of the tapered-cylindrical wall through the grounding wall to the lower edge of the bottom wall, and the groove ribs are arranged with isometric center angle, and extend radially.

In the present invention, said "certain inclined angle" of the tapered-cylindrical wall is required to retain a blow ratio of the grounding wall such that a thickness of the grounding wall has a required thickness.

That is, since the diameter of the tapered-cylindrical wall is decreased downwardly at a "certain inclined angle", the blow ratio of the grounding wall connected to the lower end of the tapered-cylindrical wall is reduced with respect to a blow ratio of the body in response to the inclined angle of the tapered-cylindrical wall. As a result, it is prevented to be the grounding wall thinner.

Since the bottom wall has a domed structure, the bottom wall exerts very high shape retention performance against changes in an inner pressure of the bottle-shaped container.

Since each of the groove ribs is arranged on the whole grounding wall in a radial direction, the groove rib reinforces the whole grounding wall, and enhances the shape retention performance of the grounding wall. Since an inner end of each of the groove ribs extends up to a lower end of the bottom wall, mechanical strength is enhanced between the grounding wall and the bottom wall. Since an outer end of each of the groove ribs extends up to an upper end of the tapered-cylindrical wall, the shape retention performance of the tapered-cylindrical wall and the connecting cylindrical wall connected to the tapered-cylindrical wall is enhanced.

Since the respective groove ribs are arranged such that they form isometric center angles, the groove ribs reinforce the grounding wall substantially even in the whole area of the grounding wall.

A portion to be grounded is segmetalized by the groove ribs. Thus, even if a part of the grounding wall is unevenly cooled to be unevenly deformed upon mold release, such unevenly deformed part does not affect the other parts.

Preferably, the tapered-cylindrical wall is formed in a regular polygonal truncated-cone shape having corners of which number is the double of a number of the groove ribs, and the groove ribs are placed on alternate edge lines of the regular polygonal truncated-cone shape.

In this preferred aspect, the edge line is arranged at a middle of a part of the tapered-cylindrical wall between coadjacent groove ribs. When strong and downward force is applied to the tapered-cylindrical wall, such edge line serves as a rib for reinforcement as well as the groove ribs.

Therefore, the reinforcing performance of the groove ribs that is applied to the tapered-cylindrical wall can be achieved with a half number of the groove ribs by means of providing the edge lines, whereby a structure of the bottom can be prevented from being complex.

PREFERRED EMBODIMENT OF THE INVENTION

One embodiment according to the present invention will be explained with reference to FIGS. 1 to 4.

Figure 1:
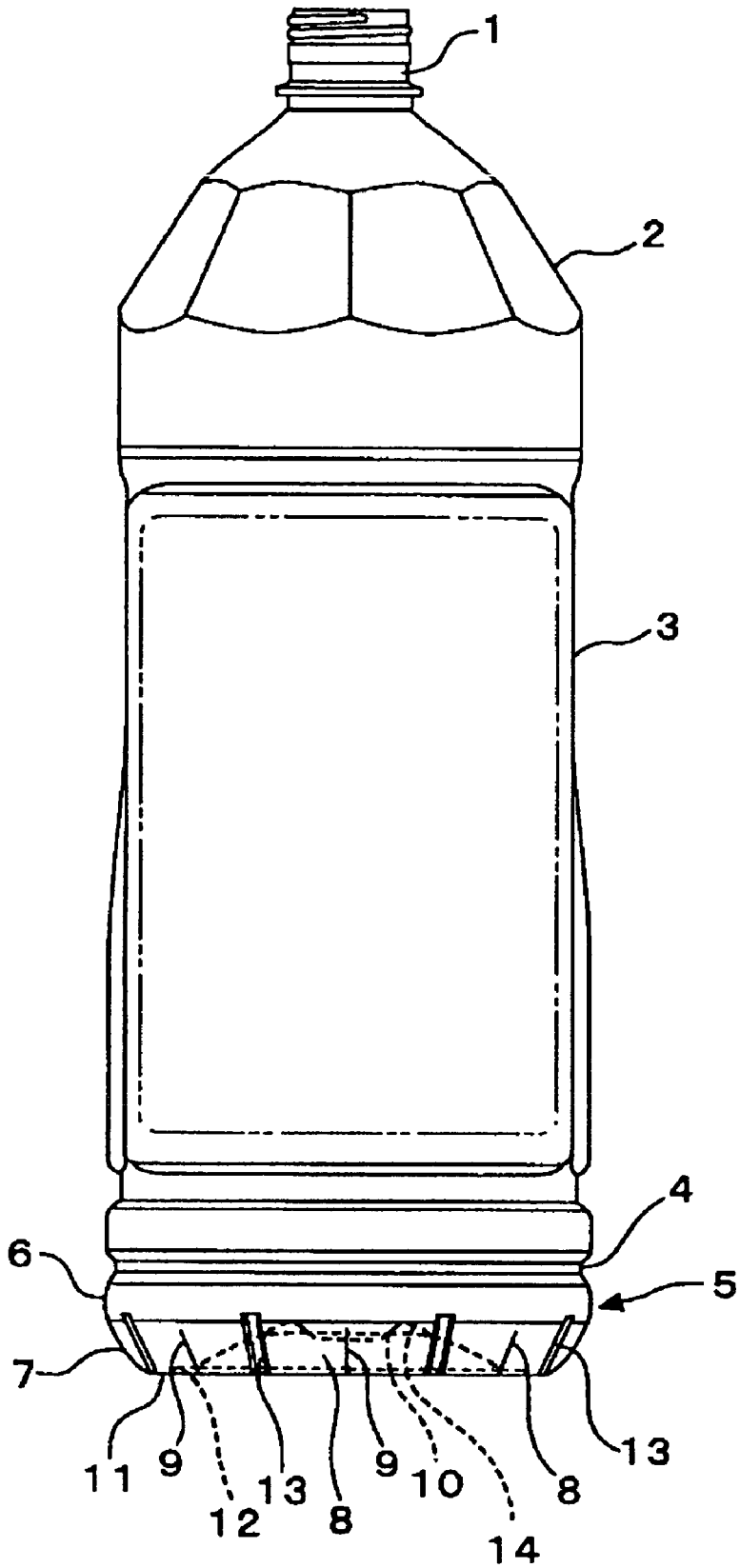
FIG. 1 is a front view of a bottle-shaped container showing one embodiment according to the present invention.
Figure 2:
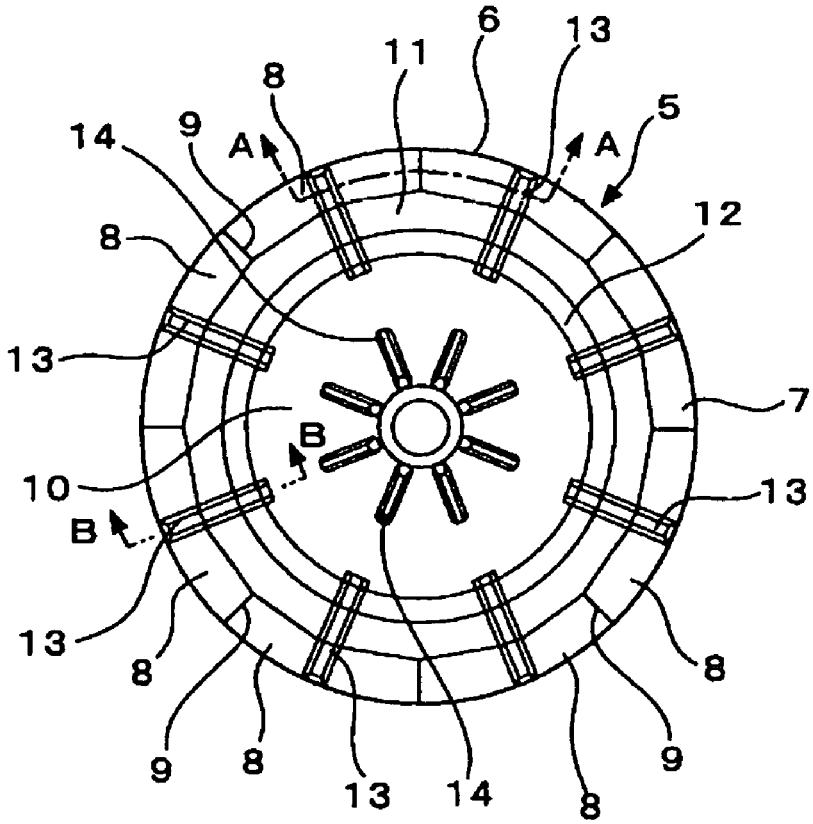
FIG. 2 is a bottom view of the bottle-shaped container shown in FIG. 1.

FIG. 1 shows a front view of a bottle-shaped container in whole according to one embodiment of the present invention. This bottle-shaped container is a biaxially-oriented blow-molded container made of polyethylene terephthalate resin, and comprises a neck 1, a shoulder 2 having a truncated cone shape, a cylindrical body 3 and a bottom 5. An upper end of the body 3 is connected to the shoulder 2, which upper end is connected to the neck 1 formed with a thread and a neck ring on an outer circumferential surface thereof. A lower end of the body 3 is connected to the bottom 5 of the present invention via a circumferential rib 4.

The bottom 5 has a connecting cylindrical wall 6, a tapered-cylindrical wall 7, a bottom wall 10 and a grounding wall 11. The connecting cylindrical wall 6 is connected to the circumferential rib 4 for enhancing rigidity of the container, and forms a heel of the bottle-shaped container. The connecting cylindrical wall 6 is connected to the tapered-cylindrical wall 7 at a lower end thereof. The tapered-cylindrical wall 7 has a diameter which is decreased downwardly, or is tapered downwardly. The bottom wall 10 is domed to an inside of the container, or is protruded upwardly, and is formed with a plurality of grooved reinforcing ribs 14 (eight ribs in the illustrated embodiment), each of which extends radially. The grounding wall 11 is formed in a ring plate shape, and is arranged between a lower edge of the tapered-cylindrical wall 7 and a lower end of the bottom 10. The bottom 5 is formed with a plurality of groove ribs 13 (eight groove ribs in the illustrated embodiment) from an upper edge of the tapered-cylindrical wall 7 through the grounding wall 11 to the lower end of the bottom wall 10. Each of the groove ribs 13 is extended radially.

In the illustrated embodiment, the tapered-cylindrical wall 7 has a regular sixteen-gonal truncated-cone shape comprising sixteen flat walls 8, and has sixteen edge lines 9. Each of the groove ribs 13 is placed on alternate edge lines. Each of the flat wall pieces 8 is inclined about 32 degree with respect to a central axis of the container, so that the tapered-cylindrical wall 7 is tapered downwardly or the diameter of the tapered-cylindrical wall 7 is reduced downwardly. With the arrangement as described above, a blow ratio of the grounding wall 11 is decreased as small as possible, and an orientation magnification at the grounding wall 11 is prevented from increasing, so as to form the grounding wall 11 with a required thickness.

Figure 3:
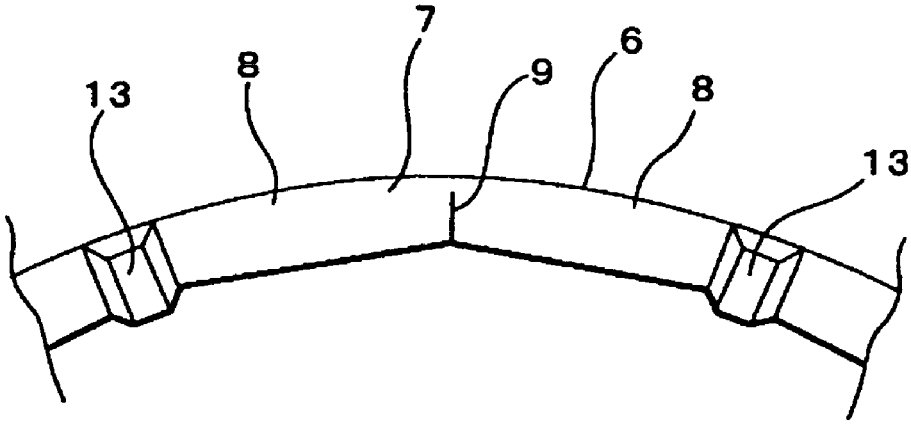
FIG. 3 is an enlarged sectional partial bottom view of the bottle-shaped container shown in FIG. 2 cut along a line A—A.

As evidently understandable from an enlarged view of FIG. 3, in a part of the tapered-cylindrical wall 7 located between coadjacent groove ribs 13, the edge line 9 having a bent wall structure is placed at a middle of said part of the tapered-cylindrical wall 7 in a circumferential direction. When a downward force is applied to the tapered-cylindrical wall 7, such edge line 9 can exert substantially same reinforcing performance as that of the groove ribs 13. Thus, in order to exert reinforcing performance for the tapered-cylindrical wall 7 that enhances the rigidity of the container to the same level, a number of the groove ribs 13 can be reduced to the half of the number that is required when the tapered-cylindrical wall 7 is formed in just a truncated cone shape.

Further, since it is possible to reduce the number of the groove ribs 13 as described above, it is thereby possible to diminish the concave/convex state or indented state of the grounding wall 11 caused by the groove ribs 13. Accordingly, degree of change in the thickness in the grounding wall 11 due to the arrangement of the groove ribs 13 can be diminished.

Figure 4:
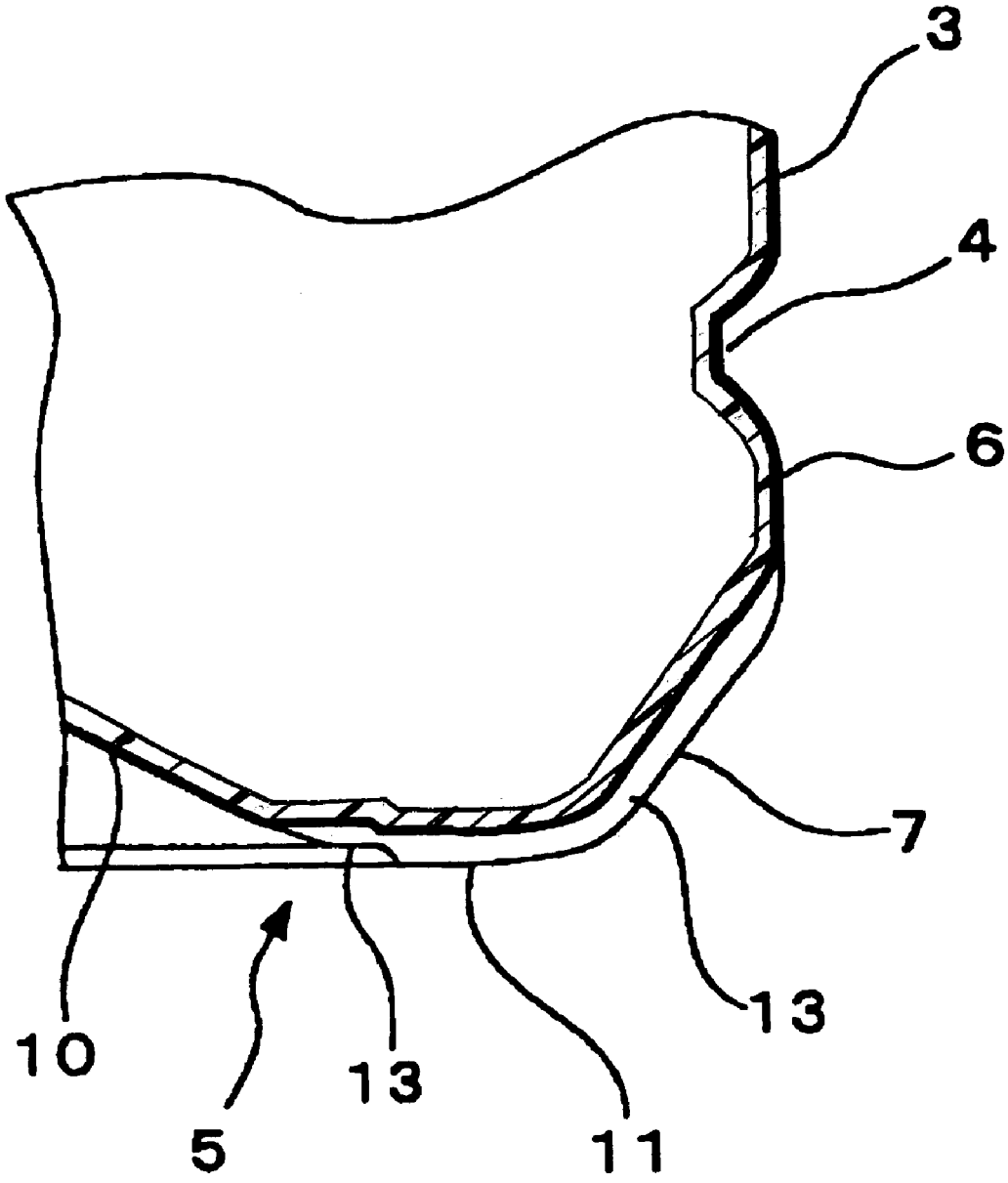
FIG. 4 is an enlarged longitudinal sectional partial view of the bottle-shaped container shown in FIG. 2 cut along a line B—B.

As shown in FIG. 4, the bottom wall 10 is provided at the lower end thereof with a flange wall 12 having a narrow flat ring plate shape. The flange wall 12 forms a low step between the bottom wall 10 and the grounding wall 11. Each of the groove ribs 13 is radially formed and concaved from the upper end of the tapered-cylindrical wall 6 (including a lower end of the connecting cylindrical wall 6) to the lower end of the bottom wall 10.

Similar to the reinforcing rib 14 radially formed and concaved on the bottom wall 10, the flange wall 12 in the bottom wall 10 serves to prevent the bottom from "bottom falls" which is caused by the shrinkage of the bottom wall 10 under cooling during molding of the bottle-shaped container. However, since the groove ribs 13 are also placed on the flange wall 12, deflected-deformation of both sides of the flange wall 12 (between the flange wall 12 and the bottom wall 10, and between the flange wall 12 and the grounding wall 11) is intensively prevented from occurring. As a result, a shape retention performance of the bottom wall 10 is enhanced largely.

In addition, since the upper end of each of the groove ribs 13 is formed on the upper edge of the tapered-cylindrical wall 7 with the lower edge of the connecting cylindrical wall 6, the connecting cylindrical wall 6 serving as the heel part of the bottle-shaped container is also reinforced.

The present invention is constituted as described above, and it has advantageous effects as described below.

The present invention can enhance the shape retention performance of the whole bottom sufficiently and firmly under a state of effectively preventing the thickness of the grounding wall in the bottom from being too thinned. Hence, with the bottle-shaped container according to the present invention, it is easily achievable to produce the bottle-shaped container in a larger size and to make its wall thinner without having difficulty and disadvantages.

In addition, since the shape retention performance of the whole bottom is enhanced, the shape retention performance of the grounding wall is naturally enhanced as well, whereby stable "seat" function of the container can be exerted.

Further, a portion to be grounded is segmetalized by the groove ribs. Thus, even if a part of the grounding wall is unevenly cooled to be unevenly deformed upon mold release, such unevenly deformed part does not affect the other parts, so as to obtain stable "seat" function of the container.

When the tapered-cylindrical wall is formed in a regular polygonal truncated-cone shape having corners of which number is the double of a number of the groove ribs, and the groove ribs are placed on alternate edge lines of the regular polygonal truncated-cone shape, the reinforcement strength can be sufficiently obtained with the half of the number of the groove ribs that is required to obtain desired reinforcement strength. Hence, it is possible to simplify the structure of the bottom, and to further diminish the changes in the thickness of the grounding wall.

What is claimed is:

1. A bottom structure of a biaxially-oriented blow-molded bottle-shaped container made of a synthetic resin, comprising a neck, a shoulder, a body and a bottom, wherein the bottom has a connecting cylindrical wall, a tapered-cylindrical wall, a bottom wall and a grounding wall, said connecting cylindrical wall connects to a lower end of the body, said tapered-cylindrical wall connects to a lower end of the connecting cylindrical wall, a diameter of said tapered-cylindrical wall is decreased downwardly at a certain inclined angle, said bottom wall is domed to an inside of the container, said grounding wall is formed in a ring plate shape, and is arranged between a lower edge of the tapered-cylindrical wall and a lower edge of the bottom wall, each of a plurality of groove ribs is formed from an upper edge of the tapered-cylindrical wall through the grounding wall to the lower edge of the bottom wall, the groove ribs are arranged with isometric center angle, and extend radially, and a plurality of reinforcing ribs are formed from proximate an upper, central portion of the bottom wall towards the lower edge of the bottom wall, the reinforcing ribs not connected to the groove ribs, wherein the tapered-cylindrical wall is formed in a regular polygonal truncated-cone shape having side edges of which number is the double of a number of the groove ribs, and the groove ribs form alternate side edges of the regular polygonal truncated-cone shape.

2. A bottom structure of a biaxially-oriented blow-molded bottle-shaped container made of a synthetic resin, comprising a neck, a shoulder, a body and a bottom, wherein the bottom has a connecting cylindrical wall, a tapered-cylindrical wall, a bottom wall and a grounding wall, said connecting cylindrical wall connects to a lower end of the body, said tapered-cylindrical wall connects to a lower end of the connecting cylindrical wall, a diameter of said tapered-cylindrical wall is decreased downwardly at a certain inclined angle, said bottom wall is domed to an inside of the container, said grounding wall is formed in a ring plate shape, and is arranged between a lower edge of the tapered-cylindrical wall and a lower edge of the bottom wall, each of a plurality of groove ribs is formed from an upper edge of the tapered-cylindrical wall through the grounding wall to the lower edge of the bottom wall, the groove ribs are arranged with isometric center angle, and extend radially, and the tapered-cylindrical wall is formed in a regular polygonal truncated-cone shape having side edges of which number is the double of a number of the groove ribs, and the groove ribs form alternate side edges of the regular polygonal truncated-cone shape.

* * * * *